United States Patent [19]

Wesebaum

[11] Patent Number: 4,735,078

[45] Date of Patent: Apr. 5, 1988

[54] TUBE EXPANDING TOOL

[75] Inventor: Paul E. Wesebaum, Elyria, Ohio

[73] Assignee: Emerson Electric Co., St. Louis, Mo.

[21] Appl. No.: 882,296

[22] Filed: Jul. 7, 1986

[51] Int. Cl.[4] ..... B21D 39/20

[52] U.S. Cl. ..... 72/393; 72/451

[58] Field of Search ..... 72/393, 409, 451; 81/362, 363

[56] References Cited

U.S. PATENT DOCUMENTS

| | | | |
|---|---|---|---|
| 880,712 | 3/1908 | Berthiaume et al. | 72/451 |
| 2,277,360 | 3/1942 | Wagner | 72/451 |
| 2,480,630 | 8/1949 | Brinen et al. | 153/80 |
| 2,575,416 | 11/1951 | Henshaw | 218/19 |
| 3,550,424 | 12/1970 | Rast | 72/399 |
| 3,821,890 | 7/1974 | Dewey | 72/325 |
| 3,837,211 | 9/1974 | Gress et al. | 72/410 |
| 3,841,133 | 10/1974 | Rice, Jr. | 72/168 |
| 4,043,164 | 8/1977 | Brookman | 72/332 |
| 4,043,171 | 8/1977 | Brookman | 72/393 |
| 4,237,718 | 12/1980 | Greenwood | 72/451 |
| 4,425,783 | 1/1984 | Rast | 72/393 |

FOREIGN PATENT DOCUMENTS

| | | |
|---|---|---|
| 488797 | 11/1977 | Australia . |
| 2552607 | 6/1977 | Fed. Rep. of Germany . |
| 2616324 | 10/1977 | Fed. Rep. of Germany . |
| 1112531 | 3/1956 | France . |
| 2304420 | 10/1976 | France . |
| 2371981 | 11/1977 | France . |
| 866994 | 3/1961 | United Kingdom . |

*Primary Examiner*—Lowell A. Larson

*Attorney, Agent, or Firm*—Body, Vickers & Daniels

[57] ABSTRACT

A tube expanding tool is disclosed which is of the character comprising a body having a fixed handle and a pivotal handle by which tapered drift pin is displaced relative to radially expandable jaws mounted on the body. A rigid link member is pivotally connected between the drift pin and pivotal handle to displace the drift pin to expand the jaws and to provide positive withdrawal of the pin from the jaws following a tube expanding operation.

10 Claims, 4 Drawing Sheets

TUBE EXPANDING TOOL

BACKGROUND OF THE DISCLOSURE

This invention relates to the art of tube expanding tools and, more particularly, to improvements in connection with a tube expanding tool of the type in which radially expandable jaws mounted on the tool body are displaced radially outwardly by movement of a coaxial drift pin in one direction relative thereto and are displaced relatively inwardly by a jaw biasing spring upon displacement of the drift pin in the opposite direction.

It is well known to provide a tube expanding tool of the character comprising a body supporting fixed and pivotal handles and tube expanding jaws which are displaced radially outwardly by means of a tapered pin which is displaced in a jaw expanding direction by means on a cam on the pivotal handle. The jaws are spring biased radially inwardly against the tapered pin to promote retraction of the pin from the jaws following a tube expanding operation and removal of the camming force against the pin. The tools disclosed in U.S. Pat. Nos. 3,550,424 to Rast; 4,043,171 to Brookman; and, 4,425,783 to Rast are exemplitive of such tube expanding tools.

In use of tools of the foregoing character, the jaws of the tool are introduced into the open end of a tube, and the pivotal handle is pivoted to displace the drift pin to expand the jaws against the inside of the tube end so as to enlarge the diameter thereof. As exemplified by the Rast and Brookman patents identified above, such previous tools have achieved the jaw expanding pin displacement by providing the pivotal handle with a cam adjacent the pivot axis thereof and which cam is cooperable with the tail end of the drift pin, or an extension thereof, to impose a lever force axially against the pin. Further in connection with accommodating manipulation of the pivotal handle by the user of the tool, it is desirable to require a pivotal displacement of the handle of no more than about 90°. In this respect, manipulation of the pivotal lever at the outset of a tube expanding operation becomes progressively more awkward and cumbersome for the user as the initial relative positioning between the fixed and pivotal handles exceeds about 90°. However, as will be seen from U.S. Pat. No. 4,425,783 to Rast mentioned above, angular displacement of the pivotal cam handle considerably greater than 90° is required in connection with the prior cam handle arrangements to obtain the desired tube expanding pin stroke with a single displacement of the pivotal handle. Efforts heretofore to obtain the necessary pin stroke with a pivotal displacement of the cam handle of about 90° has resulted in arrangements such as that shown in U.S. Pat. No. 3,550,424 to Rast mentioned above wherein the pivot axis of the pivotal handle has plural axial positions relative to the tool body to enable obtaining the desired total pin stroke by two successive manipulations of the pivotal handle, each with the pivot axis of the handle in a different one of the two positions thereof.

While cam handle arrangements of the foregoing character have provided the intended directional application of force to the drift pin, they have resulted in structural complexity, and they are cumbersome to operate either as a result of the initial angular relationship between the fixed and pivotal handles or the requirement for multiple operation to achieve a desired total stroke for the drift pin. Moreover, the sliding frictional engagement between the cam and pin and transverse to the pin axis imposes side thrust on the pin, thereby ofsetting the advantage of axial force application between the cam and pin. Furthermore, the structural complexity and/or the use of slidably engaging cam and follower surfaces undesirably adds to the cost of manufacture of the tools in that the interengaging surfaces must be precisely contoured to promote the rolling engagement therebetween as in U.S. Pat. No. 4,425,783 and must be smoothly finished to minimize friction in connection with the sliding interengagement in arrangements such as that shown in U.S. Pat. Nos. 3,550,424 and 4,043,171.

In addition to the foregoing disadvantages, the cam handle type tube expanding tools heretofore provided have relied on a garter-type spring arrangement for promoting retraction of the drift pin from between the expandable jaws and contraction of the jaws following the tube expanding operation. More particularly in this respect, the tapered end of the drift pin engages correspondingly tapered radially inner surfaces on the jaws, whereby forward movement of the drift pin in the tool body displaces the jaws radially outwardly to achieve the expansion of a tube in which the jaws are disposed. Following such tube expansion, the pivotal handle is returned toward its initial position and a garter spring surrounding the jaws provides a radially inwardly directed force thereagainst which tends to promote displacement of the tapered pin toward its initial rearward position relative to the jaws.

A considerable number of problems have been encountered in connection with use of these tools which result in damage to the tool and thus undesirably high maintenance and/or replacement costs, the damage of tubing being worked on, and frustration for the tool user. In this respect, even when such tools are new, it is often necessary to jiggle the tool relative to the tube following a tube expanding operation in order to induce initial rearward displacement of the drift pin sufficiently for the jaws to contract to enable removal of the jaws from the expanded tube. In connection with use of the tool for a period of time, the area between the drift pin and its bore and between the tapered end of the pin and the jaws becomes contaminated such as by the ingress of dirt, oil and the like. As a result of such contamination and/or through repeating sliding displacements of the pin relative to the body and jaws, the interengaging surfaces between the body, pin and jaws becomes scored. As a result of such contamination and/or scoring, the pin sticks in its forwardmost position following a tube expanding operation whereby it is difficult if not impossible to separate the tool from the expanded tube without damaging the latter and/or the tool jaws. Furthermore, such sticking of the pin requires at least initial physical displacement of the pin rearwardly of the jaws and tool body, such as by hitting the nose of the pin against a rigid surface such as a floor. Depending on the degree to which the pin is stuck, varying impacting forces are required to dislodge the pin. This eventually results in peening of the nose of the tapered portion of the pin and, more importantly, when the pin is dislodged the jaws impact against the rigid surface, causing damage and/or breakage of the jaw elements.

It will be appreciated that frequent disassembly of the tool and cleaning of the pin, body and jaw surfaces is necessitated in an effort to avoid sticking of the pin as a result of contamination and/or scoring of the tool element surfaces. It will be further appreciated that the latter results in undesirably high maintenance time and cost, and that any sticking of the pin which results in damage to an expanded tube by removal of the tool therefrom and/or damage to the pin or jaws of the tool by impacting the latter against a rigid surface likewise results in undesirably high maintenance and/or replacement costs.

SUMMARY OF THE INVENTION

In accordance with the present invention, an improved pivotal handle type tube expanding tool is provided by which the foregoing disadvantages and others of such tools heretofore provided are minimized and/or overcome. More particularly in accordance with the present invention, the pivotal handle of the tool is interconnected with the tail end of the drift pin by a rigid link member having a particular structural and dimensional interrelationship with the pin axis and with the pivot axis of the handle which enables a desired total pin stroke to be achieved with an operating pivotal displacement of the pivotal handle through an angle of about 90°. Moreover, the latter relationships enable application of the necessary pin force against the tool jaws to achieve a tube expanding displacement thereof with an exertion of force on the handles by the user generally corresponding to that required in connection with the above described cam handle tools and without lengthening the handles of such cam handle tools. Furthermore, the rigid link construction provides positive retraction of the drift pin from the jaws following a tube expanding operation and thus assures release of the tool jaws and removal of the tool from the expanded workpiece without damage to the latter, and avoids potential damage to the pin and/or tool jaws by avoiding the necessity of impacting the nose of the pin and thus the jaws against a rigid surface to release the pin. Still further, such positive retraction of the pin promotes the useful life of the pin, body and jaw elements while reducing maintenance time and cost in that contamination and scoring does not preclude positive retraction of the pin. More particularly in this respect, it will be appreciated that the pin can be positively retracted when contamination and scoring exists, and that frequent maintenance solely for the purpose of attempting to minimize sticking due to contamination and/or scoring is not necessary.

More particularly in accordance with the present invention, the rigid link member is pivotally connected to the pivotal handle at an axis spaced from the pivot axis of the handle to in effect provide a crankarm for the link and which, depending on the orientation of the pivot axis of the handle relative to the linear axis of displacement of the pin enables a desirable pin stroke to be achieved with a handle displacement of about 90°. Moreover, the location of the pivot axis of the handle relative to the pin axis, the length of the crankarm and the length of the link member together enable application of a desired force for achieving tube expansion with about the same physical exertion by the user heretofore required in connection with cam handle type tools and without lengthening the handles to increase the available leverage.

It is accordingly an outstanding object of the present invention to provide an improved tube expanding tool of the character comprising fixed and pivotal handles and a drift pin displaceable by the pivotal handle to radially displace jaws of the tool during a tube expanding operation.

Another object is the provision of an improved tool of the foregoing character in which the drift pin is interconnected with the pivotal handle of the tool by means of a rigid link which enables a desired pin stroke to be achieved with an angular displacement of the pivotal handle of about 90°.

Yet another object is the provision of an improved tool of the foregoing character wherein the drift pin, link and handle are interrelated to provide for application of a desired pin force against the tool jaws with a force exertion generally corresponding to that required with respect to tube expanding tools heretofore provided and without lengthening the handles of such prior tools.

Still another object is the provision of an improved tool of the foregoing character which enables positive retraction of the drift pin to assure release of the tool jaws from a workpiece following expansion thereof.

Yet a further object is the provision of an improved tool of the foregoing character which is more economical to produce and maintain than tools heretofore provided for the same purpose and which is efficient in operation and promotes the useful life of the component parts of the tool.

BRIEF DESCRIPTION OF THE DRAWINGS

The foregoing objects, and others, will in part be obvious and in part pointed out more fully hereinafter in conjunction with the written description of preferred embodiments of the invention shown in the accompanying drawings in which.

DESCRIPTION OF THE PREFERRED EMBODIMENTS

Figure 1:
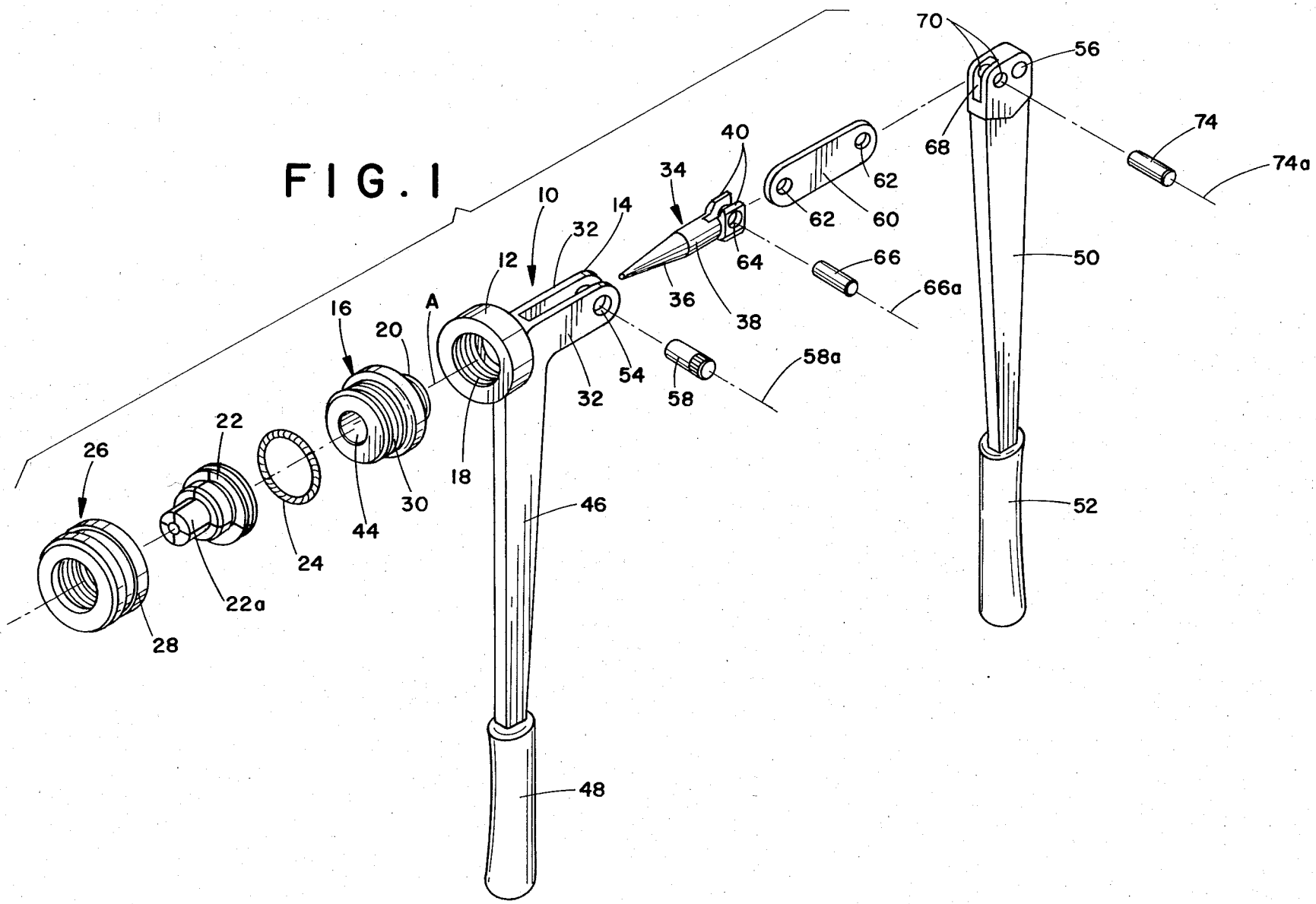
FIG. 1 is an exploded view of the component parts of a tube expanding tool made in accordance with the present invention.
Figure 2:
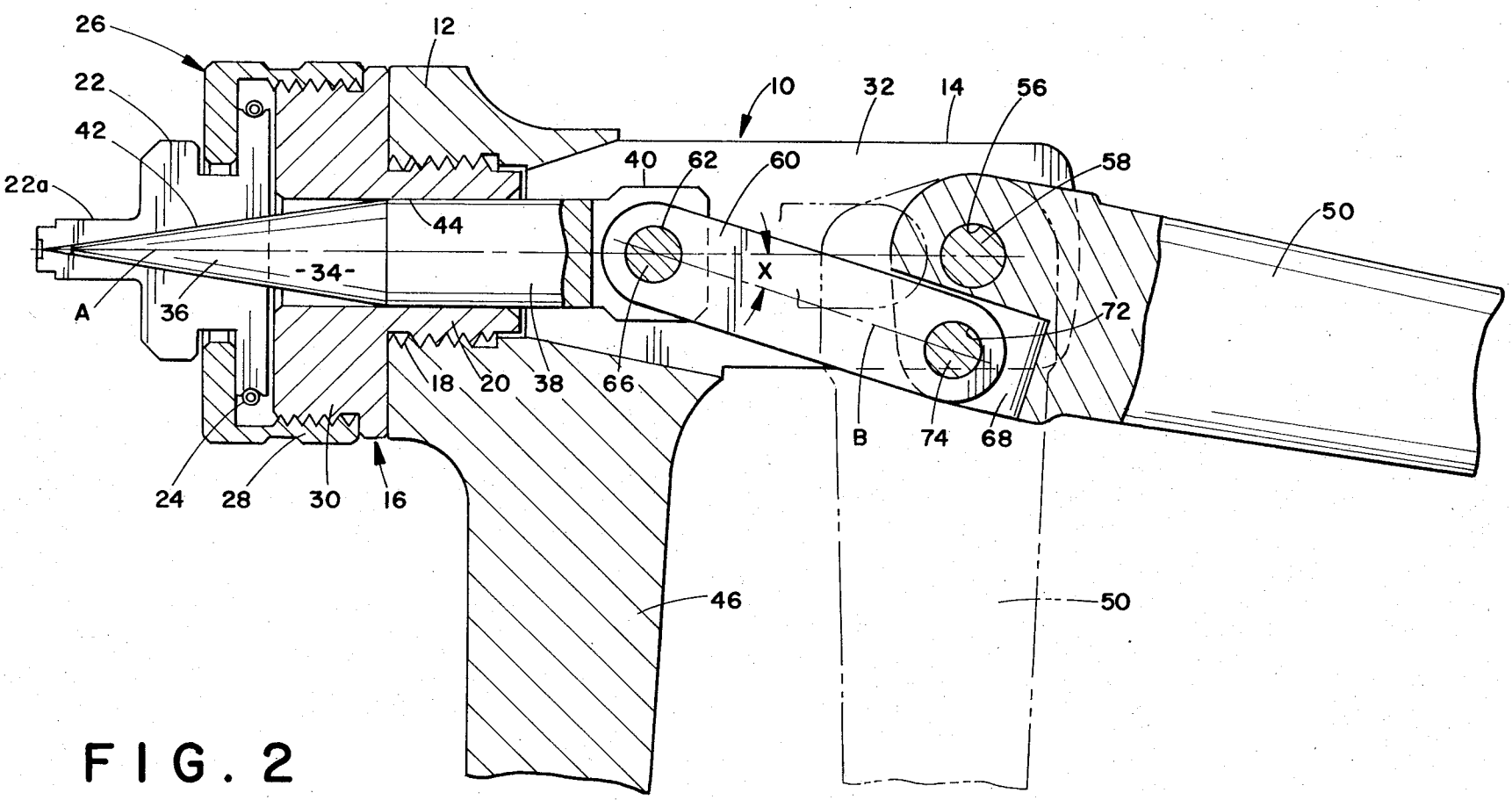
FIG. 2 is a sectional elevation view showing the component parts of the tool in the positions thereof prior to a tube expanding operation.
Figure 3:
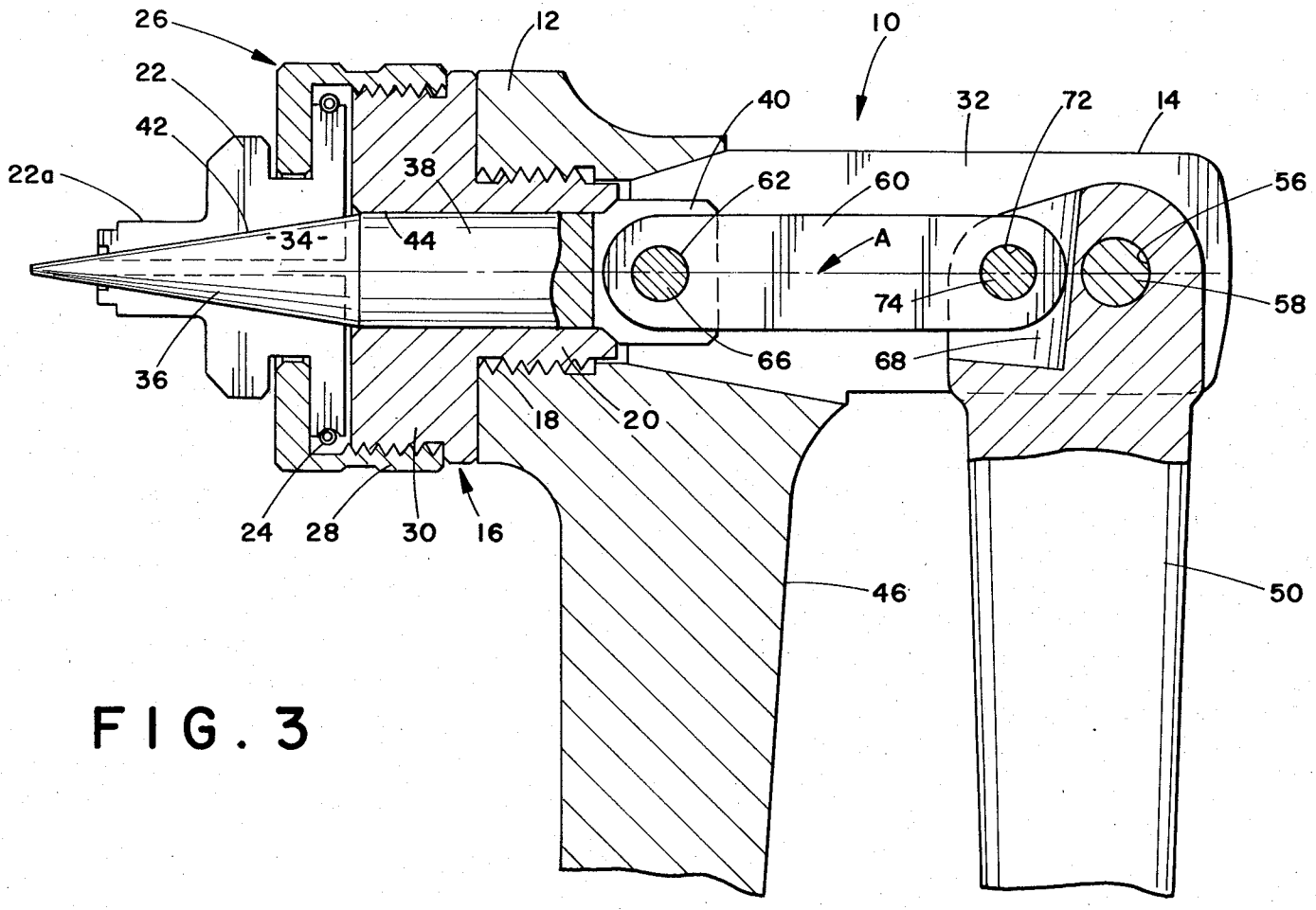
FIG. 3 is a sectional elevation view similar to FIG. 2 and showing the positions of the component parts following a tube expanding operation; and, FIG. 4 is a sectional elevation view of another embodiment of a tube expanding tool in accordance with the present invention.

Referring now in greater detail to the drawings wherein the showings are for the purpose of illustrating preferred embodiments of the invention only, and not for the purpose of limiting the invention, FIG. 1 illustrates the component parts of a tube expanding tool made in accordance with the present invention, and FIGS. 2 and 3 illustrate the component parts in assembled relationship and in different relative positional relationships corresponding to stages of a tube expanding operation. As will be seen from these Figures, the tool includes a body portion 10 having front and rear ends 12 and 14, respectively. Front end 12 of the body portion is adapted to removably receive an adapter member 16 and, for this purpose, front end 12 includes an internally threaded bore 18 and adapter 16 includes an externally threaded inner end 20 received in bore 18. A tool jaw assembly is removably supported on the outer end of adapter 16 and is comprised of a plurality of radially outwardly displaceable jaw elements 22 biased radially inwardly relative to one another and to axis A of the tool by means of a garter-type spring 24. The spring biased jaws are removably mounted on the outer end of adapter 16 by means of a cap member 26 having an internally threaded skirt portion 28 threadedly engaging externally threaded outer end 30 of adapter 16.

Rear end 14 of body 10 includes a pair of laterally spaced apart arms 32, and the tool assembly further includes a drift or drive pin 34 coaxial with axis A and including a tapered front end 36, a cylindrical intermediate portion 38 and a pair of laterally spaced apart ears 40 at the rear end thereof. When the component parts of the tool are assembled, tapered end 36 engages correspondingly tapered inner surfaces 42 of jaw elements 22, and cylindrical portion 38 slidably engages in a bore 44 in adapter 16. Body 10 further includes a fixed handle 46 depending therefrom and provided on its lower end with a suitable hand grip 48, and rear end 14 of the body supports a pivotal handle 50 having a suitable hand grip 52 on the lower end thereof. More particularly with regard to the mounting of handle 50 on body 10, the upper end of the handle is received between arms 32 on rear end 14 of body 10, and arms 14 are provided with aligned openings 54. Openings 54 are adapted to be aligned with an opening 56 through the upper end of handle 50, and the openings 54 and 56 receive a pin 58 by which the handle is pivotally mounted on body 10. Drift pin 34 and handle 50 are pivotally interconnected by means of a rigid link member 60 which has a front end received between ears 40 of pin 34 and provided with an opening 62. Opening 62 is aligned with openings 64 in ears 40 of pin 34, and openings 62 and 64 receive a pivot pin 66. The upper end of handle 50 is provided with a slot 68 having openings 70 in alignment with one another and with an opening 72 in the rear end of link 60 to receive a pivot pin 74.

As will be appreciated from FIGS. 1–3 and the foregoing description in connection therewith, handle 50 is pivotal about the axis 58*a* of pin 58 which, for purposes of the ensuing description and in connection with the embodiment illustrated provides a first pivot axis extending transverse to and intersecting drift pin axis A. The axis 74*a* of pin 74 between link 60 and handle 50 provides a second axis parallel to the first axis, and the distance between axes 58*a* and 74*a* in effect defines a crankarm for link 60. The axis 66*a* of pin 66 between link 60 and drift pin 34 provides a third axis transverse to and intersecting drift pin axis A and, accordingly, parallel to axes 58*a* and 74*a*. FIGS. 2 and 3 respectively show handle 50 in first and second positions thereof and drift pin 34 in corresponding retracted and extended positions thereof relative to jaw elements 22 and in which the jaw elements are respectively in their radially innermost positions and outermost positions relative to axis A. When the jaw elements are in their innermost positions nose portions 22*a* thereof are adapted to be received in the end of a tube to be expanded, and when the jaws are in their radially outermost positions the end of the tube has been expanded to the desired extent. As will be further appreciated from FIGS. 2 and 3, the stroke of drift pin 34 between the retracted and fully extended positions thereof corresponds generally to the length of the crankarm defined by the distance between axes 58*a* and 74*a* and is achieved through a pivotal displacement of handle 50 and thus the crankarm of about 90°.

In tube expanding tools of the character to which the present invention relates, the fixed and pivotal handles generally extend from body 10 of the tool to an extent of about twelve inches from axis A and, in accordance with the present invention, certain relationships between the pivotal handle 50, link member 60 and drift pin 34 enable tube expansion to be achieved with about the same manual force exertion by the operator as that required with the cam handle-pin type tools heretofore available and without lengthening the handles to increase the leverage, without employing multiple stroke displacement of the drift pin, and without requiring a displacement of the pivotal handle of more than about 90° relative to the tool body. These attributes are achieved in accordance with the present invention by providing a crankarm length or distance between axes 58*a* and 74*a* which together with the location of axis 58*a* relative to drift pin axis A and the length of link 60 as determined by the distance between second and third axes 74*a* and 66*a* will provide the desired drift pin stroke with a maximum angle X of no more than 25° between axis A and a line B between second and third axes 74*a* and 66*a* during pivotal displacement of handle 50 between its first and second positions. In the embodiment shown in FIGS. 1–3, the desired maximum angle is achieved by providing for axis 58*a* to intersect axis A and by providing a crankarm to link length ratio of about 1:3.25.

Figure 4:
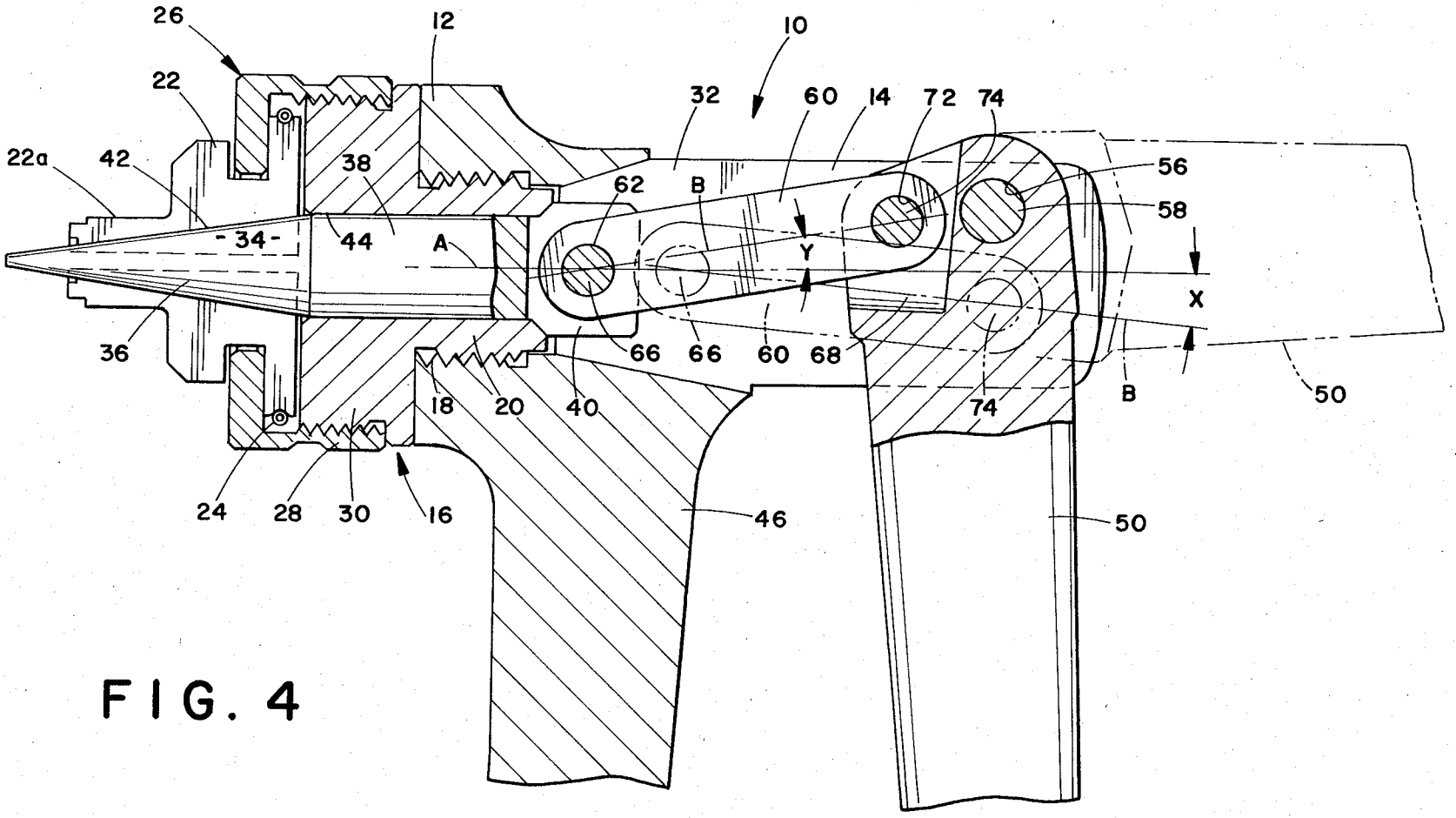

With reference now to FIG. 4 of the drawing, there is illustrated a modification of the embodiment shown in FIGS. 1–3 whereby the position of pin 58 for pivotal handle 50 is relocated relative to axis A and so as to be positioned above the latter axis. All of the component parts of the tool shown in FIG. 4 correspond to those of the embodiment illustrated in FIGS. 1–3, whereby like numerals appear in FIG. 4 in connection with designating such component parts. In the modification shown in FIG. 4, the linear distance between the axes 58*a* and 74*a* is the same as that in the embodiment of FIGS. 1–3 as is the length of link 60. When handle 50 is in the solid line position shown in FIG. 4, drift pin 34 has been displaced by link 60 to the fully extended position thereof. Counterclockwise rotation of handle 50 in FIG. 4 to the broken line position of the handle displaces drift pin 34 from the extended to the retracted position thereof.

During pivotal displacements of handle 50 and corresponding displacements of drift pin 34 between the extended and retracted positions thereof, the axis of pin 74 crosses axis A, and line B between the axes of pins 66 and 74 is displaced so as to form angles X and Y with axis A and respectively below and above the latter axis. Each of the angles X and Y in the embodiment of FIG. 4 is considerably less than the maximum angle of 25° described above in connection with the embodiment shown in FIGS. 1–3. It will be appreciated from FIG. 4 that the leverage with respect to displacing drift pin 34 from its retracted position during initiation of a tube expanding operation is about the same as the leverage toward the end of the forward stroke of the draft pin whereas, in comparison with the embodiment of FIGS. 1–3, the latter provides better leverage toward the end of the forward stroke of the drift pin than at the beginning of the forward stroke. Accordingly, it will be appreciated from the two embodiments illustrated herein, that a wide variety of leverage arrangements can be provided in accordance with the present invention to achieve desired force characteristics in connection with a tube expanding operation. Such varying force characteristics may be desirable in connection with such factors as the size and wall thickness of tubing to be expanded and the material of the tubing. Further in connection therewith, it will be appreciated that handle pivot pin 58 could be mounted on tool body 10 so as to enable adjusting the position thereof and thus the position of axis 58*a* relative to drift pin axis A.

While considerable emphasis has been placed herein on the specific structures and structural interrelationships between the component parts of the embodiments disclosed, it will be appreciated that many changes can be made in the embodiments disclosed and that other embodiments can be made without departing from the principals of the present invention. In this respect, for example, it will be appreciated that the structural relationships between the drift pin and tool jaws could be reversed so that the drift pin would be pulled axially inwardly of the jaws to expand the latter. In connection with such a modification, handle 50 would be displaced from the broken line position to the solid line position shown in FIG. 2 to achieve the jaw expansion. As another example, the positions of the fixed and pivoted handles could be reversed with respect to the direction between the front and rear ends of the body. With the latter modification, the pivoted handle would be disposed forwardly and away from the fixed handle to displace the drift pin forwardly to expand the tool jaws. The foregoing and other modifications will be suggested or obvious to those skilled in the art from the description of preferred embodiments herein. Accordingly, it is to be distinctly understood that the foregoing descriptive matter is to be interpreted merely as illustrative of the invention and not as a limitation.

Having thus described the invention, it is claimed:

1. In a tube expanding tool of the character comprising body means having front and rear ends, a bore extending into said body means from said front end, said front end being adapted to removably receive radially expandable jaw means coaxial with said bore, pin means coaxial with and slidably received in said bore, said pin means having a tapered front end radially expanding said jaw means in response to displacement of said pin means axially in said bore, and means to displace said pin means relative to said bore, the improvement comprising: said means to displace said pin means including a handle mounted on said body means adjacent said rear end for pivotal displacement about a first pivot axis, and a rigid link member having opposite ends pivotally attached one to said handle at a second pivot axis radially spaced from said first axis and the other to said pin means at a third pivot axis axially inwardly of said tapered front end.

2. A tool according to claim 1, wherein said handle has first and second positions and said pin means has first and second positions relative to said front end of said body means and corresponding respectively to said first and second positions of said handle, and a line through said second and third axes forms an angle with the axis of said bore no greater than about 25° during displacement of said handle between said first and second positions thereof.

3. A tool according to claim 1, wherein the distance between said second and third axes is about 3.25 times the distance between said first and second axes.

4. A tool according to claim 1, wherein said first axis intersects the axis of said bore.

5. A tool according to claim 4, wherein said handle has first and second positions and said pin means has first and second positions relative to said front end of said body means and corresponding respectively to said first and second positions of said handle, and a line through said second and third axes forms an angle with the axis of said bore no greater than about 25° during displacement of said handle between said first and second positions thereof.

6. A tool according to claim 4, wherein the distance between said second and third axis is about 3.25 times the distance between said first and second axes.

7. A tool according to claim 6, wherein said handle has first and second positions and said pin means has first and second positions relative to said front end of said body means and corresponding respectively to said first and second positions of said handle, and a line through said second and third axes forms an angle with the axis of said bore no greater than about 25° during displacement of said handle between said first and second positions thereof.

8. A tool according to claim 1, wherein said handle has first and second positions and said pin means has first and second positions relative to said front end of said body means and corresponding respectively to said first and second positions of said handle, a line through said second and third axes forming an angle with the axis of said bore no greater than about 25° during displacement of said handle between first and second positions thereof, and the distance between said second and third axes is about 3.25 times the distance between said first and second axes.

9. A tool according to claim 1, wherein said first axis is radially spaced from the axis of said bore.

10. A tool according to claim 9, wherein said handle has first and second positions and said pin means has first and second positions relative to said front end of said body means and corresponding respectively to said first and second positions of said handle, said second axis intersecting the axis of said bore during displacement of said handle from said first to said second position thereof.

* * * * *

Disclaimer 4,735,078.—*Paul E. Wesebaum*, Elyria, Ohio. TUBE EXPANDING TOOL. Patent dated Apr. 5, 1988. Disclaimer filed Feb. 6, 1990, by the assignee, Emerson Electric Co.

Hereby enters this disclaimer to claims 1 and 9 of said patent.

[*Official Gazette May 1, 1990* ]